US006477352B2

(12) United States Patent
Takahashi et al.

(10) Patent No.: US 6,477,352 B2
(45) Date of Patent: Nov. 5, 2002

(54) TWO-SIDED IMAGE FORMING APPARATUS

(75) Inventors: Masahiro Takahashi, Kashiwa (JP); Takayuki Kato, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/803,972

(22) Filed: Mar. 13, 2001

(65) Prior Publication Data

US 2001/0036379 A1 Nov. 1, 2001

(30) Foreign Application Priority Data

Mar. 15, 2000 (JP) ..... 2000-072958
Jun. 21, 2000 (JP) ..... 2000-186937
Jun. 30, 2000 (JP) ..... 2000-199567

(51) Int. Cl.[7] ..... G03G 15/00
(52) U.S. Cl. ..... 399/401
(58) Field of Search ..... 399/361, 364, 399/381, 388, 394, 396, 401; 271/3.01, 3.15, 161, 184, 188, 225, 209

(56) References Cited

U.S. PATENT DOCUMENTS 5,086,320 A 2/1992 Koike ..... 271/176
5,448,348 A 9/1995 Azeta ..... 399/364
5,523,833 A 6/1996 Tomari et al. ..... 399/381
5,557,391 A * 9/1996 Kato et al. ..... 399/401
5,713,060 A 1/1998 Sato et al. ..... 399/20
5,725,209 A 3/1998 Takahashi et al. ..... 271/122
5,765,086 A 6/1998 Kishino et al. ..... 399/329
5,966,578 A 10/1999 Soutome et al. ..... 399/333
6,067,439 A 5/2000 Kadokura et al. ..... 399/388

FOREIGN PATENT DOCUMENTS

EP 0 529 919 9/1993

* cited by examiner

*Primary Examiner*—Hoan Tran
(74) *Attorney, Agent, or Firm*—Fitzpatrick, Cella, Harper & Scinto

(57) ABSTRACT

An image forming apparatus including an image forming device for forming an image on a sheet, a re-conveying path for re-conveying the sheet on one side of which the image has been formed to the image forming device for forming an image on the other side of the sheet and a sheet containing portion for feeding the sheet to a conveying path interflowing into the middle of the re-conveying path, wherein, when the sheet on one side of which the image has been formed is once stopped and waited in the re-conveying path, a leading end of the sheet is positioned downstream of the interflowing position.

9 Claims, 6 Drawing Sheets

LS : LENGTH OF SHEET IN CONVEYING DIRECTION
L1 : DISTANCE BETWEEN FIXING DEVICE AND LARGE DIAMETER ROLLER

TWO-SIDED IMAGE FORMING APPARATUS

BACKGROUND OF THE INVENTION

1. Field of the Invention

The present invention relates to an image forming apparatus such as a copying apparatus, a facsimile apparatus or a printer, capable of two-sided image formation.

2. Related Background Art

In such conventional image forming apparatus, a sheet is fed from a feeding tray by a pickup roller and through paired separating rollers and through a conveying path, further conveyed by paired registration rollers in synchronism with the rotation of a photosensitive drum, and receives, on an upper surface of the sheet, a toner image from the photosensitive drum in transfer means. Then the sheet is passed by a conveying unit and the toner image on the sheet is thermally fixed in fixing means.

After a photosensitive drum is primarily charged by charging means, the photosensitive drum is exposed by exposure means so that An electrostatic latent image is formed on a surface of the photosensitive drum. The electrostatic latent image is visualized with toner supplied by developing means so that a toner image to formed.

A configuration for executing the foregoing steps up to the thermal fixation of the toner image on the sheet constitutes image forming means. The image forming means may also have other configurations such as based on the ink jet system.

The sheet afterimage formation is then subjected to either straight discharge, or surface reversed discharge, or conveyed again to the transfer means for the purpose of two-sided image formation.

A two-side reversing unit is provided with paths for two-sided image formation, and is separable from the main body of the apparatus in a pullout type.

In the following, the conveying operation of the sheet after the fixing means will be explained in detail, following the flow of the sheet.

In case of two-sided image formation, the sheet is guided through a conveying path by the switching of a first discharge flapper, and guided to a surface reverse conveying path by the switching of a first duplex flapper.

The arrival of the conveyed sheet is detected by sheet detection means.

Based on a sheet arrival signal and information on the sheet length in the conveying direction, a CPU in the main body of the apparatus judges the timing of stopping and reversing (in the counterclockwise direction) of a roller and controls the driving of the roller.

The CPU stops and reverses the roller when the trailing end of the sheet passes a second duplex flapper but is positioned in front of a driven roller.

The conveyed sheet is conveyed by paired conveying rollers arranged in succession to the transfer means for the image formation on the second surface.

The image forming apparatus capable of executing the above-described operations has recently been digitized for example in the copying apparatus and is formed as a composite apparatus having also functions of printer and facsimile. For such composite apparatus, a higher speed is required in recent years in order to improve the productivity.

As a method for realizing such high speed, high speed conveying control is adopted for the sheet in the conveying path to the transfer means when the sheet is conveyed to the transfer means.

The sheet is conveyed from a sheet containing portion by a pickup roller to paired separating rollers, which conveys the uppermost one, among the sheets picked up by the pickup roller, to paired conveying rollers.

A sensor for detecting a leading end of the sheet is provided just before or just after the paired conveying roller. When the sensor detects the leading end of the sheet, the sheet is once stopped and waiting in a state that the sheet is nipped by the paired conveying rollers.

Thereafter, the conveying operation is started again at a timing capable of forming a predetermined distance to the immediately preceding sheet.

This is to enable an increase in the conveying speed of the sheet, at the high speed conveying control, by maintaining an appropriate distance to the immediately preceding conveyed sheet. If without such control, the immediately preceding sheet S conveyed at the predetermined speed by the paired registration rollers toward the transfer means may be caught up by the succeeding sheet S conveyed at the increased speed thereby resulting a damage in the sheet or a double conveying of the sheets.

After such correction of the conveying distance, the sheet is conveyed to the paired registration rollers at a speed higher than the conveying speed on the transfer means. Subsequently, this control is repeatedly executed.

Also, in case of two-sided image formation, for the purpose of high-speed conveying control, the leading end of the sheet is detected by a sensor provided in the middle of the re-conveying path, whereby the sheet is once stopped and waits in a predetermined position while it is pinched between the paired conveying rollers, and the sheet conveying is started again at a time when a predetermined distance is formed to the immediately preceding sheet.

The above-described conventional technology has however been associated with the following drawback.

In the conventional technology, it is necessary to secure, within the conveying path, a waiting space corresponding to the length of the sheet in the conveying direction, so that the conveying path has to be made sufficiently long.

Because of such long conveying path, the compactization or the space saving in the main body of the image forming apparatus has not been possible.

SUMMARY OF THE INVENTION

In consideration of the foregoing, the object of the present invention is to provide an image forming apparatus capable of compactization of the apparatus while maintaining a high productivity in the two-sided image formation.

The above-mentioned object can be attained, according to the present invention, by an image forming apparatus comprising:

image forming means for forming an image on a surface of a conveyed sheet;

a re-conveying path for re-conveying a sheet, on which an image has been formed on one side of the sheet, to the image forming means to form images on both sides of the sheet by the image forming means; and a sheet containing portion for feeding the sheet to a conveying path interflowing to the middle of the re-conveying path;

wherein, in case the sheet, on which the image has been formed on one side of the sheet, is once stopped and waits in the re-conveying path, the leading end of the stopped and waiting sheet, on which the image has been formed on one side of the sheet is positioned downstream of the interflowing position.

In addition there are preferably provided:

a surface reverse conveying path provided upstream of the re-conveying path, for reversing the surfaces of the sheet on which the image has been formed on one side of the sheet;

an arc-shaped conveying path connecting the surface reverse conveying path and the re-conveying path; and a conveying roller, having an external periphery at the surface on the inner diameter side of the arc-shaped conveying path.

In the present invention, as explained in the foregoing, in case a sheet on which an image has been formed on one side of the sheet is once stopped and waits in the re-conveying path, the leading end of the sheet on which the image has been formed on one side of the sheet, thus made to stop and wait, is positioned downstream of the interflowing position in the middle of the re-conveying path Where a conveying path from the sheet containing portion interflow, whereby the re-conveying path downstream of the interflowing position is utilized in common by the sheet newly fed from the sheet containing portion and the sheet made to stop and wait in the high speed conveying control. Consequently the waiting space for such stopped and waiting sheet, corresponding to the sheet length in the conveying direction, may be secured in the re-conveying path, whereby achieved are compactization and space saving of the main body of the image forming apparatus. It is thus rendered possible to achieve compactization of the apparatus, while attaining a high productivity by executing the high speed conveying control in the two-sided image formation.

Also because of the presence of a surface reverse conveying path provided upstream of the re-conveying path, for reversing the surfaces of the sheet on which the image has been formed on one side of the sheet, an arc-shaped conveying path connecting the surface reverse conveying path and the re-conveying path; and a conveying roller having an external periphery at the surface on the inner diameter side of the arc-shaped conveying path, the surfaces of the sheet on which the image has been formed on one side of the sheet is reversed before being conveyed to the re-conveying path, and there can be prevented a loss in time, caused by reversing the surfaces of the sheet during the subsequent high-speed conveying control. Also as the leading end of the sheet made to once stop and wait is positioned downstream of the interflowing position, the sheet once stopped and waited in the re-conveying path can be prevented from being interfered by the conveying rollers provided upstream of the re-conveying path.

BRIEF DESCRIPTION OF THE DRAWINGS

FIGS. 4A and 4B are charts showing a speed control for a conveying speed of a large-diameter roller as a rotary member of a embodiment according to the present invention, wherein FIG. 4A shows the speed control in a case the sheet length in the conveying direction is larger than the distance between a fixing device and a large-diameter roller, while FIG. 4B shows the speed control in a case the sheet length in the conveying direction is smaller than the distance between the fixing device and the large-diameter roller;

DESCRIPTION OF THE PREFERRED EMBODIMENTS

In the following, the present invention will be clarified in detail by preferred embodiments thereof, with reference to the accompanying drawings. However, the dimension, material, shape and relative arrangement of the components described in the embodiments are not intended to limit the present invention to such description unless stated otherwise specifically.

Figure 1:
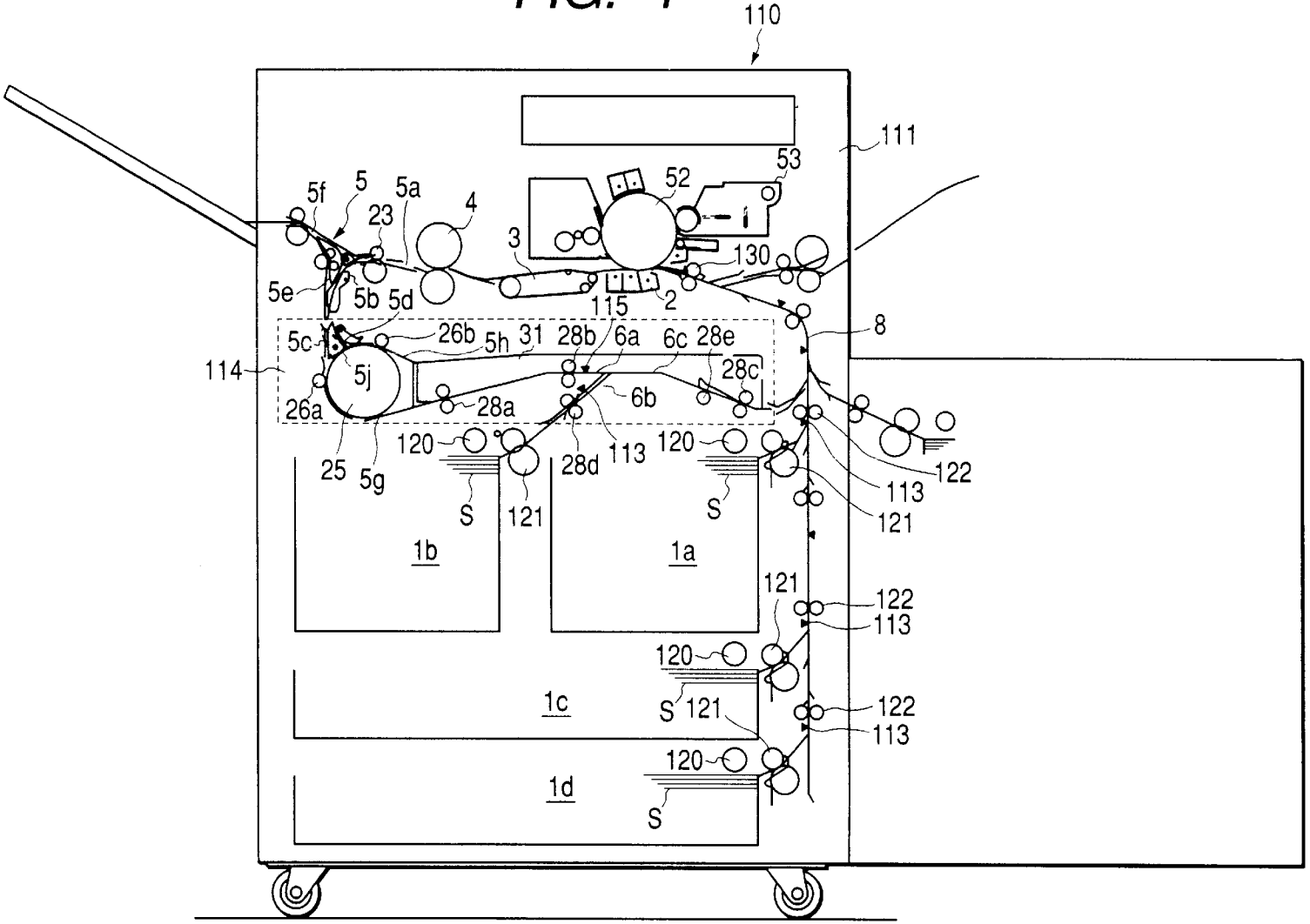
FIG. 1 is a schematic cross-sectional view of an image forming apparatus of an embodiment according to the present invention.

FIG. 1 is a schematic cross-sectional view of a main body of an image forming apparatus. Referring to FIG. 1. a sheet S is fed from a feeding tray 1 (1*a*–1*d*) by a pickup roller 120 to paired separating rollers 121 through a conveying path 8, further conveyed by paired registration rollers 130 in synchronism with the rotation of a photosensitive drum 52, and receives, on an upper surface of the sheet, a toner image from the photosensitive drum 52 in transfer means 2. Then the sheet S is passed by a conveying unit 3 and the toner image on the sheet S is thermally fixed by a fixing device 4.

After the photosensitive drum 52 is primarily charged by charging means, the photosensitive drum is exposed by exposure means so that an electrostatic latent image is formed on a surface of the photosensitive drum. The electrostatic latent image is visualized by toner supplied by a developing device 53 so that a toner image to be transferred onto the sheet S by the transfer means 2 is formed.

A configuration for executing the foregoing steps up to the thermal fixation of the toner image on the sheet constitutes image forming means. The image forming means may also have other configurations such as based on the ink jet system.

The sheet S after an image formation is then subjected to either straight discharge (conveying paths 5*a*–5*f* (a first conveying path), or surface reversed discharge (conveying paths 5*a*–5*b* (a second conveying path)—a conveying path 5*c* (a third conveying path)—a conveying path 5*e*–*a* conveying path 5*f*), or conveyed again to the transfer means 2 (the conveying path 5*a*–the conveying path 5*b*–*a* conveying path 5*d*–*a* conveying path 5*h* as a surface reverse conveying path (a fourth conveying path)—a conveying path 5*j*–conveying paths 5*g*, 6*a*, 6*c*, 8 as a re-conveying path) for the two-sided image formation.

In FIG. 1, a two-side reversing unit 114 surrounded by a broken line is provided with paths (5*d*, 5*h*, 5*j*, 5*g*, 6*a*, 6*c*) for the two-sided image formation, and is separable from the main body of the apparatus in a pullout type.

The two-side reversing unit 114 is provided with a large-diameter roller 25 as a forward and reverse rotatable conveying roller having an external periphery of the same radius of curvature as that of an arc-shaped conveying path (conveying paths 5*h*—5*j*—5*g*) as a conveying path defined on an arc. Thus, this large-diameter roller 25 having the external periphery which is a surface of an inner diameter of the arc-shaped conveying path. Around the large-diameter roller 25, there are provided driven rollers 26*a*, 26*b* which are rotated integrally with the large-diameter roller 25.

In the following, the conveying operation of the sheet S from the fixing means 4 onwards will be explained in detail with reference to FIG. 2, following the flow of the sheet S.

The changeover between the path for the straight discharge and the path for the surface reversed discharge is executed by the first discharge flapper 51, which is controlled by drive means such as a solenoid (not shown).

In a case of the surface reversed discharge, the sheet S is guided to the conveying path 5*b* by the switching of the first discharge flapper 51, and then to the conveying path 5*c* by the switching of the first duplex flapper 21 as switch means. The changeover of the first duplex flapper 21 is made by drive means such as a solenoid (not shown).

The conveyed sheet S is drawn into the conveying path 5*g* by the counterclockwise rotation of the large-diameter roller 25 and the rotation of the driven roller 26*a*. In this operation, the arrival of the sheet S is detected by sheet detection means 27*a* provided downstream of the driven roller 26*a*.

Though not shown in detail, the sheet detection means 27*a* may be for example composed of a flag protruding in the conveying path but having a center of rotation outside the conveying path so as to be rotated by the contact with the leading end of the sheet S and a photointerruptor in which the gap between the light emitting portion and the light receiving portion thereof is intercepted by a shield plate provided on the flag.

Based on a sheet arrival signal and information on the length of the sheet S in the conveying direction, a CPU in the main body of the apparatus judges the timing of stopping and reversing (in the clockwise direction) of the large-diameter roller 25 and controls the driving of the large-diameter roller 25.

The CPU stops and reverses the large-diameter roller 25 when the trailing end of the sheet S passes the second discharge flapper 52 but is positioned in front of the two-side reversing unit 114.

Figure 2:
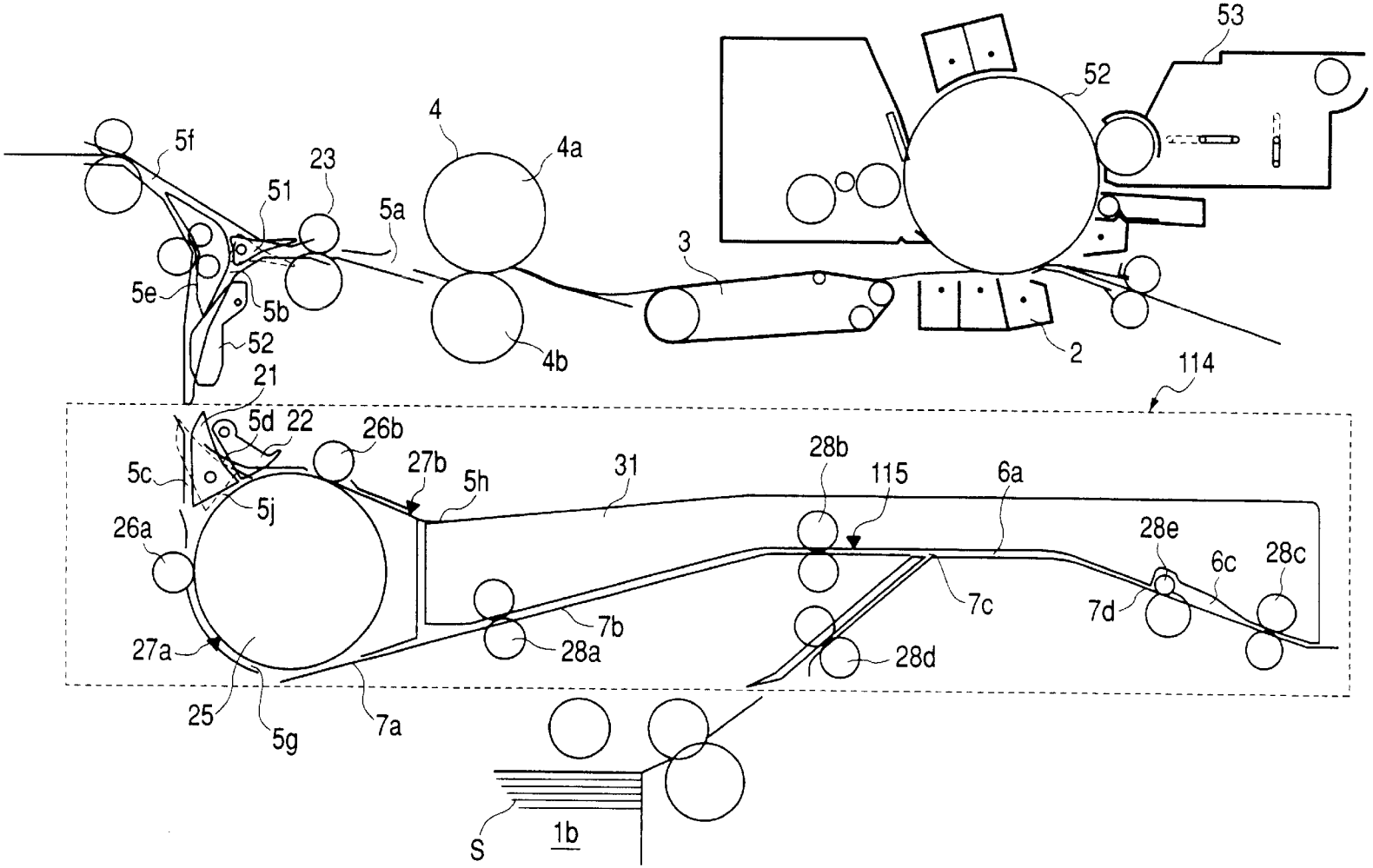
FIGS. 2 and 3 are schematic cross-sectional views of a two-side reversing unit of an embodiment according to the present invention.

The second discharge flapper 52 is biased by a spring force or the self-weight thereof to the left in FIG. 2, and is so provided as to prevent the reverse motion of the sheet S, to be directed upwards after reversing, from entering the conveying path 5*b*, thereby guiding the sheet S after reversing to the conveying route (conveying paths 5*e*–5*f*).

If the sheet S to be discharged with its surfaces reversing has a large length in the conveying direction, the conveying rollers 28*a*, 28*b* are driven in synchronism with the large-diameter roller 25 to accommodate the drawing direction of such long sheet S.

In the case of two-sided image formation, the sheet S is guided through the conveying path 5*b* by the switching of the first discharge flapper 51, and then to the conveying path 5*d* by the switching of the first duplex flapper 21.

The conveyed sheet S is drawn into the conveying path 5*h* by the clockwise rotation of the large-diameter roller 25 and the rotation of the driven roller 26*b*. In this operation, the arrival of the sheet S is detected by sheet detection means 27*b* provided downstream of the driven roller 26*b*.

Based on a sheet arrival signal and information on the length of the sheet S in the conveying direction, the CPU in the main body of the apparatus judges the timing of stopping and reversing (in the counterclockwise direction) of the large-diameter roller 25 and controls the driving of the large-diameter roller 25.

The CPU stops and reverses the large-diameter roller 25 when the trailing end of the sheet S passes the second duplex flapper 22 but is positioned in front of the driven roller 26*b*.

The second duplex flapper 22 is biased, like the second discharge flapper 52, by a spring force or the self-weight thereof downwards in FIG. 2, and is so provided as to prevent the reverse motion of the sheet S, to be directed to the left after its surface reversing, from entering the conveying path 5*d*, thereby guiding the sheet S after its surface reversing to the conveying path 5*j*.

The sheet S, conveyed in the arc-shaped conveying path (paths 5*g*–5*g*) along the external periphery of the large-diameter roller 25, is conveyed from the conveying path 5*g* to the conveying route (the conveying paths 6*a*–6*c*) by the paired conveying rollers 28*a*, 28*b*, 28*e*, 28*c* arranged in succession, then interflows into the conveying path 8 for conveying to the transfer means 2 for the image formation on the second side.

In this image forming apparatus, the high speed conveying control is executed for the sheet S in the conveying path to the transfer means 2 when the sheet S is conveyed to the transfer means 2, thereby attaining a high productivity. The high speed conveying control will be explained in the following with reference to FIGS. 1 and 2.

The sheet S is conveyed by the pickup roller 120 from the sheet containing portions 1*a*–1*d* to the paired separation rollers 121, which advances, among the sheets S picked up by the pickup rollers 120, only the uppermost one to the paired conveying rollers 122 or 28*d*.

Immediately in front of or behind the paired conveying rollers 122, 28*d*, a sensor 113 is provided for detecting the leading end of the sheet S, and the sheet S of which the leading end is detected by the sensor 113 once stops and waits in a predetermined position in a state pinched by the paired conveying rollers 122, 28*d*.

Thereafter, the conveying operation is started again at a timing when a predetermined conveying distance is formed to the immediately preceding sheet S.

This is to enable an increase in the conveying speed of the sheet S, at the high speed conveying control, by maintaining an appropriate distance to the immediately preceding conveyed sheet. If without such control, the immediately preceding sheet S conveyed at the predetermined speed by the paired registration rollers 130 toward the transfer means 2 may be caught up by the succeeding sheet S conveyed with the increased speed thereby resulting in a damage in the sheet or a double conveying of the sheets.

After such correction of the conveying distance, the sheet S is conveyed to the paired registration rollers 130 with a speed higher than the conveying speed on the transfer means. Thereafter this control is executed repeatedly.

Also, in the case of two-sided image formation, for the purpose of high-speed conveying control, the leading end of the sheet S is detected by a sensor 115 provided in the middle of the re-conveying path (the conveying paths 5*g*–6*a*–6*c*), whereby the sheet S is once stopped and waits in a predetermined position while it is pinched between the paired conveying rollers 28*b*, and the sheet conveying is started again at a timing when a predetermined distance is formed to the immediately preceding sheet S.

The present image forming apparatus is so constructed that the distance of the conveying route from the terminal end 7*a* of the arc-shaped conveying paths (5*c*–5*g*), of which the inner diameter side surface corresponds to the external periphery of the large-diameter roller 35, to a position 7*d* immediately in front of the first paired conveying rollers 28*e* downstream of the interflowing portion 7*c* where the conveying path from the sheet containing portion 1*b* interflows into the re-conveying path is equal to or larger than the longitudinal length of a small-sized sheet (for example A4 size) usable in the apparatus, and that the distance of the conveying route from the terminal end 7*a* to the interflowing portion 7*c* is less than the longitudinal length of such small-sized sheet.

It is also so constructed that the distance of the conveying route from a position 7*b* immediately behind the first paired conveying rollers 28*a* after the terminal end 7*a* to the immediately front position 7*d* is equal to or larger than the shorter length of the small-sized sheet, and that the distance of the conveying route from the immediately behind position 7*b* to the interflowing portion 7*c* is less than the shorter length of the small-sized sheet.

In the case of two-sided image formation on a sheet (for example of A4R size) in the image forming apparatus of the above-described configuration, there is executed the high-speed conveying control, and, when the leading end of the sheet S on one side of which an image has been formed, conveyed into the re-conveying path by the large-diameter roller 25, is detected by the sensor 115, and the sheet S is made to stop and wait in order to correct the conveying distance to the immediately preceding sheet S, the paired conveying rollers 28*a*, 28*b* are so controlled that the leading end of the stopped and waiting sheet S is positioned at the immediately front position 7*d* downstream of the interflowing position 7*c* where the conveying path from the sheet containing portion 1*b* interflows into the middle of the re-conveying path.

In this manner there can be secured a waiting space, corresponding to the length of the sheet S in the conveying direction, in the conveying route from the terminal end 7*a* of the re-conveying path to the immediately front position 7*d*, thereby enabling an operation to cause the sheet S to once stop and wait in the re-conveying path and to immediately thereafter convey the sheet S for the two-sided image formation (rotating the large-diameter roller 25 to convey the sheet S to the conveying path 5*d* or thereafter reversing the surfaces of the sheet S in the conveying path 5*h* for conveying to the conveying path 5*g*), and also reducing the length of the conveying route from the terminal end 7*a* to the interflowing portion 7*c* in comparison with the conventional configuration, whereby the compactization of the apparatus can be realized.

Also in the case a new sheet S is fed from the sheet containing portion 1*b* while a preceding sheet S is stopped and waits in the re-conveying path, a part of the re-conveying path downstream of the interflowing portion 7*c* can be used in common by the stopped and waiting sheet S and the new sheet S.

More specifically, the new sheet S fed from the sheet containing portion 1*b* is conveyed by the paired conveying rollers 28*d*, 28*e*, 28*c* to a position between the stopped and waiting sheet S and one lateral surface of the re-conveying path.

It is therefore only required to secure a waiting space corresponding to the length, in the conveying direction, of the stopped and waiting sheet S in the conveying route from the terminal end 7*a* of the re-conveying path to the immediately front position 7*d*, thereby enabling compactization and space saving in the main body of the image forming apparatus. In this manner, the high-speed conveying control in the two-sided image formation allows to achieve compactization of the apparatus while maintaining a high productivity.

Figure 3:
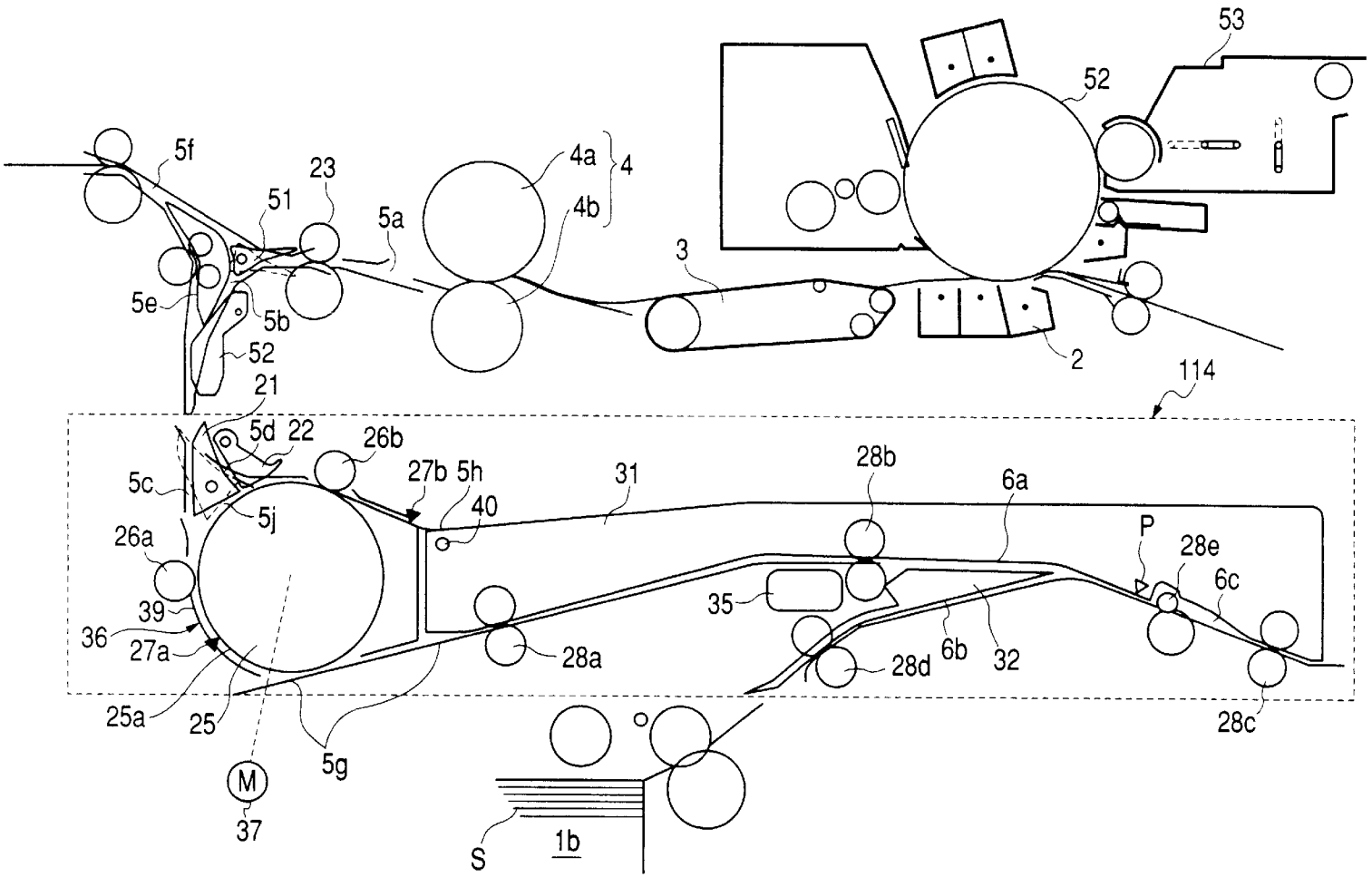

On the other hand, referring to FIG. 3, the two-side reversing unit 114, surrounded by a broken line, can be extracted from the main body 111 of the copying apparatus 110 for clearing a jammed sheet. The two-side reversing unit 114 is provided with a large-diameter roller 25 as a rotary member capable of forward and reverse rotation and having an external periphery of the substantially same radius of curvature as that of a curved portion 36 (the conveying paths 5*h*, 5*j* and 5*g*) as a curved conveying route. The external periphery 25*a* of the large-diameter roller 25 constitutes an inner diameter surface as an internal guide wall of the curved portion 36, which is defined by the external periphery 25*a* of the large-diameter roller 25 and an external guide plate 39. Driven rollers 26*a*, 26*b* are in pressure contact with and rotated by the large-diameter roller 25.

In the present embodiment, the radius of curvature of the large-diameter roller 25 is selected substantially equal to that of the curved portion 36, but may also be selected smaller than that of the curved portion 36 for attaining similar effects.

In the following there will be explained the conveying of the sheet S downstream of the fixing device 4 in the sheet conveying direction, with reference to FIG. 3 and along the movement of the sheet S.

(Straight Discharge)

The paths for straight discharge and surface reversed discharge are switched by the first discharge flapper 51, which is controlled by drive means such as a solenoid. In the straight discharge, the sheet S is discharged to the exterior through the conveying paths 5*a*, 5*f* (the first conveying path).

(Surface Reversed Discharge)

In the surface reversed discharge, the sheet S is conveyed through the conveying paths 5*a*, 5*b* (the second conveying path) and the conveying path 5*c* (the third conveying path), and conveyed reversely through the conveying paths 5*e*, 5*f* so that the sheet is discharged face down. However, if the sheet S is long, the sheet S is conveyed through the conveying paths 5*a*, 5*b* (the second conveying path), the conveying path 5*c* (the third conveying path) and the conveying path 5*g*, and conveyed reversely through the conveying paths 5*c*, 5*e*, 5*f* so that the sheet is discharged face down.

In the case of the surface reversed discharge, the sheet S is guided from the conveying path 5*a* to the conveying path 5*b* by the switching of the first discharge flapper 51, and then to the conveying path 5*c* by the switching of the first duplex flapper 21 which is controlled by drive means such as a solenoid.

The sheet S conveyed to the curved portion 36 is drawn into the conveying path 5*g* by the counterclockwise rotation of the large-diameter roller 25 and the rotation of the driven roller 26*a*. In this operation, the arrival of the sheet S is detected by the sheet detection means 27*a* provided downstream of the driven roller 26*a*. Though not shown in detail, the sheet detection means 27 may be composed of, for example, a flag protruding in the conveying path but having a center of rotation outside the conveying path so as to be rotated by the contact with the leading end of the sheet S, and a photointerruptor in which the gap between the light emitting portion and the light receiving portion thereof is intercepted by a shield plate provided on the flag, thereby detecting the sheet.

Based on a sheet arrival signal and information on the length of the sheet S in the conveying direction, a CPU of a control device as the sheet conveying control means of the main body 111 of the copying apparatus 110 judges the timing of speed control, stopping and reversing (in the clockwise direction) of the large-diameter roller 25 and controls the driving of the large-diameter roller 25. The speed of the large-diameter roller 25 in drawing the sheet and conveying the sheet is different depending on the sheet size (sheet length) in the conveying direction, in order to increase the productivity of the entire copying apparatus 110. Also depending on the size, the speed is increased in the course of conveying of one sheet S.

Figure 4A:
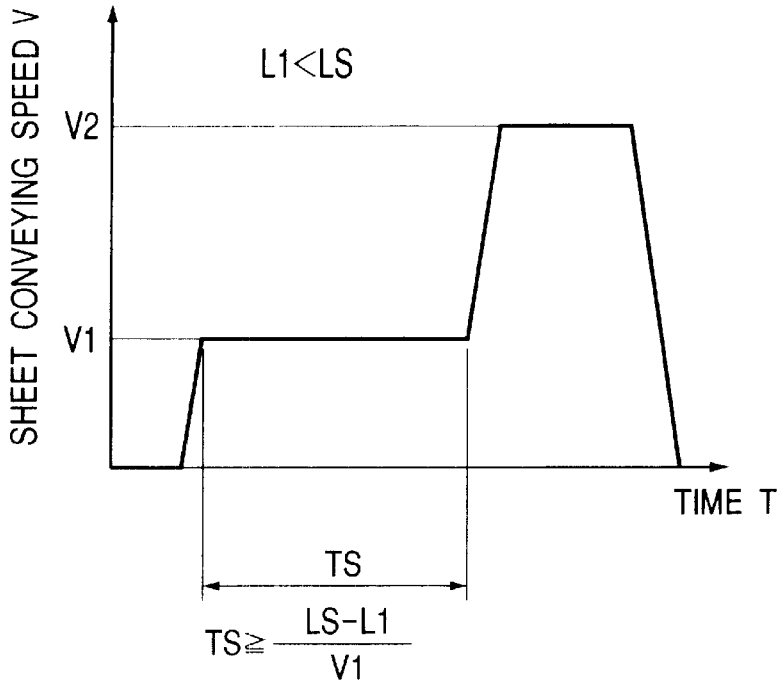

A specific example of speed control will be explained with reference to speed control chart shown in FIGS. 4A and 4B, in which the ordinate indicates the sheet conveying speed V of the large-diameter roller 25 and the abscissa indicates the time T, and which show the control on time and speed according to the sheet size in the conveying direction. As the fixing device 4 is required to convey the sheet at a process speed, the sheet conveying speed V1 of the large-diameter roller 25 has to be the substantially same as the sheet conveying speed of the fixing device 4 while the sheet extends from the fixing device 4 to the nip between the large-diameter roller 25 and the driven roller 26*a*. Therefore, in the case the sheet size (LS) in the conveying direction is larger than the distance (L1) from the fixing device 4 to the nip between the large-diameter roller 25 and the driven roller 26*a* (L1<LS), the control device so controls a motor 37 for rotating the large-diameter roller 25 as to rotate the large-diameter roller 25 at at the same low speed V1 as the sheet conveying speed of the fixing device 4 until the trailing end of the sheet comes out of the fixing device 4 and thereafter rotate the large-diameter roller 25 at a high speed V2 (FIG. 4A).

Therefore, the sheet conveying time (TS) of the large-diameter roller 25 at the low speed V1 has to satisfy a condition:

$$TS \geqq (LS-L1)/V1$$

Figure 4B:
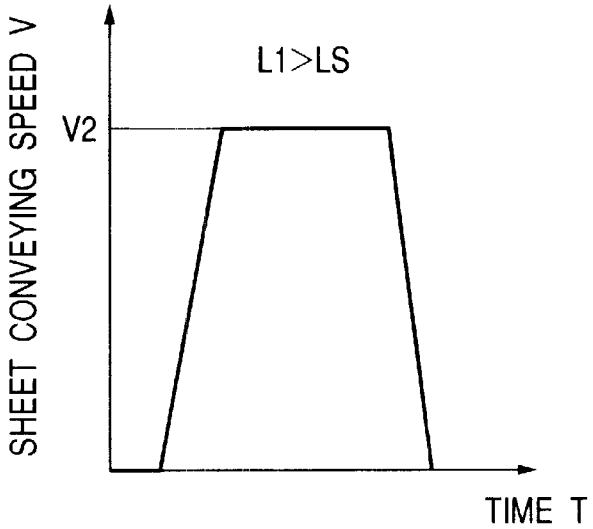

In the case the sheet size (LS) in the conveying direction is smaller than the distance (L1) from the fixing device 4 to the nip between the large-diameter roller 25 and the driven roller 26*a* (L1>LS), the sheet is not at all restricted by the fixing device 4, so that the control device rotates the large-diameter roller 25 at a high speed V2 from the beginning (FIG. 4B). Therefore the sheet is drawn at the high speed by the large-diameter roller 25.

In such speed control of the large-diameter roller 25, paired conveying rollers 23 positioned between the fixing device 4 and the large-diameter roller 25 may have the same sheet conveying speed as that of the large-diameter roller 25 or may for example be provided with a one-way clutch so as to be capable of free rotation in the sheet conveying direction, whereby the sheet drawing is executed by the large-diameter roller 25.

In the copying apparatus 110, as explained in the foregoing, the sheet drawing and conveying speed of the large-diameter roller 25 and the driven roller 26*a* for the sheet S through the conveying path 5*c* is rendered variable according to the sheet size, so that the surface reversing operation for the sheet S can be executed at a highest possible speed while observing the restriction on the sheed conveying speed of the fixing device 4, whereby a high productivity can be attained.

The CPU stops the large-diameter roller 25 after the trailing end of the sheet S passes the second discharge flapper 52 and before the trailing end reaches the two-side reversing unit 114, thereby initiating the surface reversing operation. The second discharge flapper 52 is biased by a spring force or the self-weight thereof leftward in FIG. 2, and is so provided as to prevent the sheet S, to be directed upwards after the surface reversing of the sheet S, from entering the conveying path 5*b*, thereby guiding the sheet S to the conveying route (the conveying paths 5*e*–5*f*). If the sheet S has a large size in the conveying direction, the paired conveying rollers 28*a*, 28*b* as the sheet conveying means are driven in synchronism with the large-diameter roller 25 to respond to the enlarged drawing amount for the longer sheet S.

(Re-conveying to Image Forming Means for Two-sided Image Formation)

The sheet S is guided to the conveying path 5*b* by the switching of the first discharge flapper 51, and then to the conveying path 5*d* by the switching of the first duplex flapper 21. The conveyed sheet S is drawn into the conveying path 5*h* by the clockwise rotation of the large-diameter roller 25 and the rotation of the driven roller 26*b*. In this operation, the arrival of the sheet S is detected by sheet detection means 27*b* provided downstream of the driven roller 26*b*.

Based on a sheet arrival signal and information on the length of the sheet S in the conveying direction, the CPU of the main body 111 of the copying apparatus 110 judges, as in the aforementioned case of surface reversed discharge, the timing of speed control, stopping and reverse rotation (in the counterclockwise direction) of the large-diameter roller 25 and controls the motor 37 for rotating the large-diameter roller 25. In order to increase the productivity of the entire copying apparatus 110, the sheet drawing and conveying speed caused by the large-diameter roller 25 and the driven roller 26*b* in drawing and conveying the sheet thrugh the conveying path 5*h* to the large-diameter roller 25 is different depending on the sheet size (sheet length) in the conveying direction, as in the case of surface reversed discharge shown in FIGS. 4A and 4B. Also depending on the size, the sheet drawing and conveying speed caused by the driven roller 26*b* and the large-diameter roller 25 is increased in the course of one sheet conveying. In the following description, reference is made again to FIGS. 4A and 4B, in which L1 is to be replaced by L3.

As the fixing device 4 is required to convey the sheet at a process speed, the sheet conveying speed V1 of the large-diameter roller 25 has to be substantially the same as the sheet conveying speed of the fixing device 4 while the sheet extends from the fixing device 4 to the nip between the large-diameter roller 25 and the driven roller 26*b*. Therefore, in the case the sheet size (LS) in the conveying direction is larger than the distance (L3) from the fixing device 4 to the nip between the large-diameter roller 25 and the driven roller 26*b* (L3<LS), the control device so controls a motor 37 for rotating the large-diameter roller 25 as to rotate the large-diameter roller 25 at a low speed V1 which is the same as the sheet conveying speed of the fixing device 4 until the trailing end of the sheet comes out of the fixing device 4 and then rotate the large-diameter roller 25 at a high speed V2 (FIG. 4A) after the trailing end of the sheet comes out of the fixing device 4.

Therefore, the sheet conveying time (TS) of the large-diameter roller 25 at the low speed V1 has to satisfy the following condition:

$$TS \geqq (LS-L3)/V1$$

In the case the sheet size (LS) in the conveying direction is smaller than the distance (L3) from the fixing device 4 to the nip between the large-diameter roller 25 and the driven roller 26*b* (L3>LS), the sheet is not at all restricted by the fixing device 4, so that the control device rotates the large-diameter roller 25 at a high speed V2 from the beginning (FIG. 4B). Therefore the sheet is drawn at the high speed by the large-diameter roller 25.

The CPU stops the large-diameter roller 25 after the trailing end of the sheet S passes the second duplex flapper 22 and before the trailing end reaches the driven roller 26*b*, thereby initiating the surface reversing operation for the sheet S. The second duplex flapper 22 is biased, like the second discharge flapper 52, by a spring force or the self-weight thereof downward in FIG. 2, and is so provided as to prevent the sheet S, to be directed leftward in FIG. 2 after the surface reversing, from entering the conveying path 5*d*, thereby guiding the sheet S to the conveying path 5*j*.

The sheet S, conveyed in the arc-shaped conveying path (the conveying paths 5*g*–5*g*) along the external periphery of the large-diameter roller 25, is conveyed in the conveying route (the conveying paths 6*a*–6*c*) by the paired conveying rollers 28*a*, 28*b*, 28*c*, then interflows into the conveying path 8 for being conveyed to the transfer means 2 for the image formation on the second side.

In the case of the two-sided image formation, a sheet from the feed tray 1 for the image formation on the first side and a sheet for the image formation on the second side are alternately supplied to the transfer means 2. For this reason, the sheet supplied for the image formation on the second side is once stopped on the conveying route (the conveying paths 6*a*–6*c*) and is restarted to interflow into the conveying path 8 according to the conveying timing of the sheet from the feed tray 1 and the status of operation of an image writing portion or the image forming portion. Since the sheet supplied for the image formation on the second side is conveyed, after the re-starting, on the conveying path 8 at the same conveying speed as that of the sheet supplied for the image formation on the first side, so that such conveying speed is lower than in the two-side reversing unit 114 in which a high speed is adopted for attaining a high productivity. As a result, at the surface reverse conveyance after the darwing of the sheet from the fixing device 4 is completed, there are required high and low sheet conveying speeds for the large-diameter roller 25 for conveying the sheet toward the conveying paths 5*j*, 5*g*, 6*a*, 6*c* depending upon the sheet size in the conveying direction.

More specifically, when the size of the sheet S in the conveying direction is sufficiently small, namely when the sheet size is such that the sheet is positioned between the downstream side of the nip of the paired conveying rollers 28*a* and a predetermined position, to be explained later, of the downstream end of the conveying paths 6*a*, 6*c* and is pinched by the paired conveying rollers 28*b*, the sheet, which is once stopped on the conveying paths 6*a* and 6*c* upon arrival of the leading end of the sheet at the aforementioned predetermined position, is conveyed to the conveying path 8 at the low speed by the paired conveying rollers 28*b*, 28*c*. At substantially the same time, the sheet existing on the conveying path 5*h* after the drawing of the sheet from the fixing device 4 is completed is conveyed at the high speed by the large-diameter roller 25 and the paired conveying rollers 28*a* through the conveying path 6*a* to the conveying path 6*c*. The aforementioned predetermined position at the downstream end of the conveying paths 6*a*, 6*c* means a position P (FIG. 3) upstream of and in the vicinity of the paired conveying rollers 28*e* to the extent that the sheet is not nipped by the paired conveying rollers 28*e*.

On the other hand, when the size of the sheet S in the conveying direction is sufficiently large, namely when the sheet size is such that the sheet is positioned between the downstream side of the nip of the large-diameter roller 25 and the driven roller 26*b* and the predetermined position P in the downstream end of the conveying paths 6*a*, 6*c*, and is pinched in the nip between the large-diameter roller 25 and the driven roller 26*a* and in the nips of the paired conveying rollers 28*a*, 28*b*, the sheet, which is once stopped on the conveying paths 6*a* and 6*c* upon arrival of the leading end of the sheet at the aforementioned predetermined position P, extends at the trailing end to the nip between the large-diameter roller 25 and the driven roller 26*a*. Therefore, in contrast to the aforementioned situation for the small-sized sheet, different sheets cannot be present respectively on the conveying paths 6*a*, 6*c* and on the conveying path 5*h* at the same time. As a result, at the start of conveying the sheet by the large-diameter roller 25 and the paired conveying rollers 28*a*, from the conveying path 5*h* to the conveying paths 6*a*, 6*c*, no preceding sheet is present on the conveying paths 6*a*, 6*c* and the large-diameter roller 25 can convey the succeeding sheet at the high speed, without any restriction.

However, in the case that the sheet length in the conveying direction is a middle size between the aforementioned two cases, namely such that the sheet is positioned between the downstream side of the nip of the large-diameter roller 25 and the driven roller 26*a* and the predetermined position P at the downstream end of the conveying paths 6*a*, 6*c* and is pinched in the nips of the paired conveying rollers 28*a*, 28*b*, the sheet, which is once stopped on the conveying paths 6*a* and 6*c* upon arrival of the leading end of the sheet at the aforementioned predetermined position P, extends at the trailing end to the paired conveying rollers 28*a* so that the trailing end of the sheet is pinched by the paird conveying rollers 28*a*. Therefore, the paired conveying rollers 28*a* is to convey the sheet at the low speed, and there may result an unmatching of the speed on the paired conveying rollers 28*a* if the sheet conveyed from the conveying path 5*h* at substantially the same time is conveyed at the high speed. However, if there is selected,for such middle-sized sheet, such control as not to place a sheet on the conveying paths 6*a*, 6*c* and another sheet on the conveying path 5*h* as in the case of the large-sized sheet, there will result another drawback of a lowered productivity in total regardless how fast is the sheet conveying by the large-diameter roller 25 and the paired conveying rollers 28*a* from the conveying path 5*h* to the conveying paths 6*a*, 6*b*. In order to avoid such drawback, for the middle-sized sheet, the conveyance of the sheet by the large-diameter roller 25 and the paired conveying rollers 28*a* from the conveying path 5*h* to the conveying paths 6*a*, 6*c* is executed at the low speed which is the same as the speed of the preceding sheet, thereby avoiding the speed unmatching on the paired conveying rollers 28*a* and achieving a high productivity.

As explained in the foregoing, the copying apparatus 110 can attain a high productivity by varying the sheet conveying speed of the large-diameter roller 25 for conveying the sheet to the conveying paths 5*j*, 5*g*, 6*a* and 6*c* in the two-sided image formation, according to the sheet size in the conveying direction.

(Two-side Reversing Unit)

In the following there will be explained, with reference to FIG. 3, the configuration of the two-side reversing unit 114.

As explained in the foregoing, the external periphery 25*a* of the large-diameter roller 25 capable of rotation in the forward and reverse direction and having the same curvature as that of the curved conveying route (the conveying paths 5*h* , 5*j*, 5*g* ) serves as the internal wall surface (internal guide wall) on the inner diameter side of the above-mentioned curved conveying route, so that, with respect to the sheet S conveyed in the curved portion 36, the internal wall surface of the curved portion 36 moves at the same speed as the conveying speed of the sheet itself. In general, a sheet conveyed in the curved portion 36 (particularly a portion causing a change in the direction by 180° or larger) is subjected to a resistance which is strongly influenced by the frictional resistance of the internal wall surface, and such frictional resistance of the internal wall surface increases for a higher rigidity and a larger thickness of the sheet.

The radius of curvature of the curved portion 36 is becoming smaller because of the recent requirement for compactization of the copying apparatus. The above-described configuration allows to reduce the frictional resistance of the internal wall surface to practically zero, thereby being extremely effective for reducing the conveying resistance of the sheet S.

In particular, there can be secured stable conveying operation, even in the high-speed conveying, for the sheet of a high rigidity such as of a basis weight of about 200 g/m$^2$, required recently in the market.

Also in comparison with the sheet conveying in succession by the plural pairs of the conveying rollers, the configuration of driving a large-diameter roller 25 provided with plural driven rollers allows to simplify the driving system, thereby reducing the cost and the operation noise. Also there can be dispensed with the guide member at the internal periphery of the curved portion 36, thereby simplifying the configuration and reducing the cost.

Figure 5:
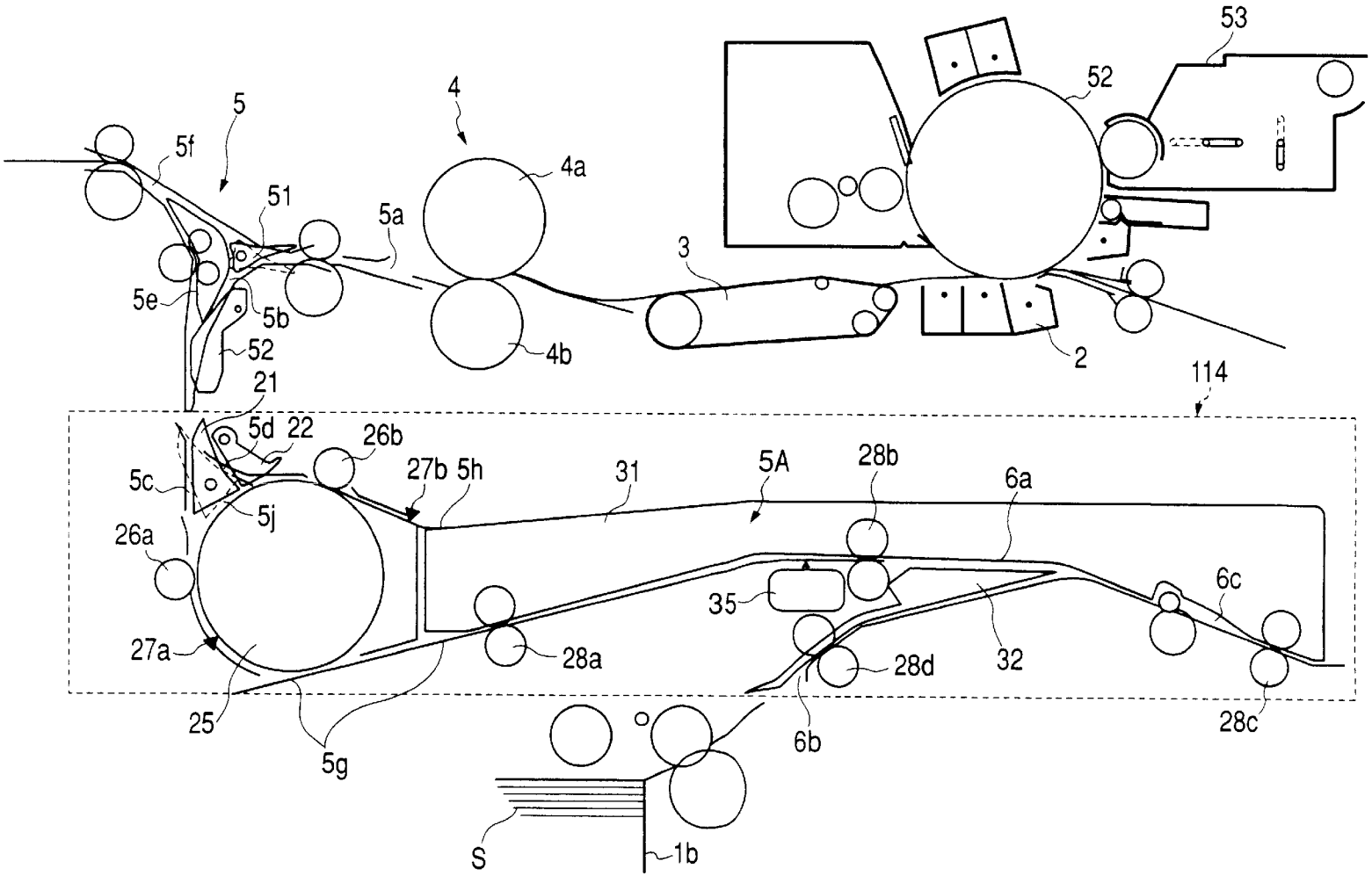
FIG. 5 is a view showing a sheet conveying path from the fixing device of the aforementioned image forming apparatus onwards.

Furthermore, as shown in FIG. 5, the conveying path 5*h* is provided on the upper surface of an openable and closable guide 31 while the conveying paths 5*g*, 6*a*, 6*c* are provided on the lower surface thereof. The openable and closable guide 31 is openable and closable about an axis 40, so that the user can easily execute jam clearance of the two-side reversing unit 114.

When the sheet S is conveyed onto the conveying path 5*h*, the sheet S is supported by the driven roller 26*b* and the large-diameter roller 25, so that the lower side of the sheet S is guided by the openable and closable guide 31 while the upper side of the sheet S is made substantially free. Consequently, in the jam clearance, the user can draw the two-side reversing unit 114 from the main body 111 of the copying apparatus 110 and can easily remove the jammed sheet from the conveying path 5*h*.

Figure 6:
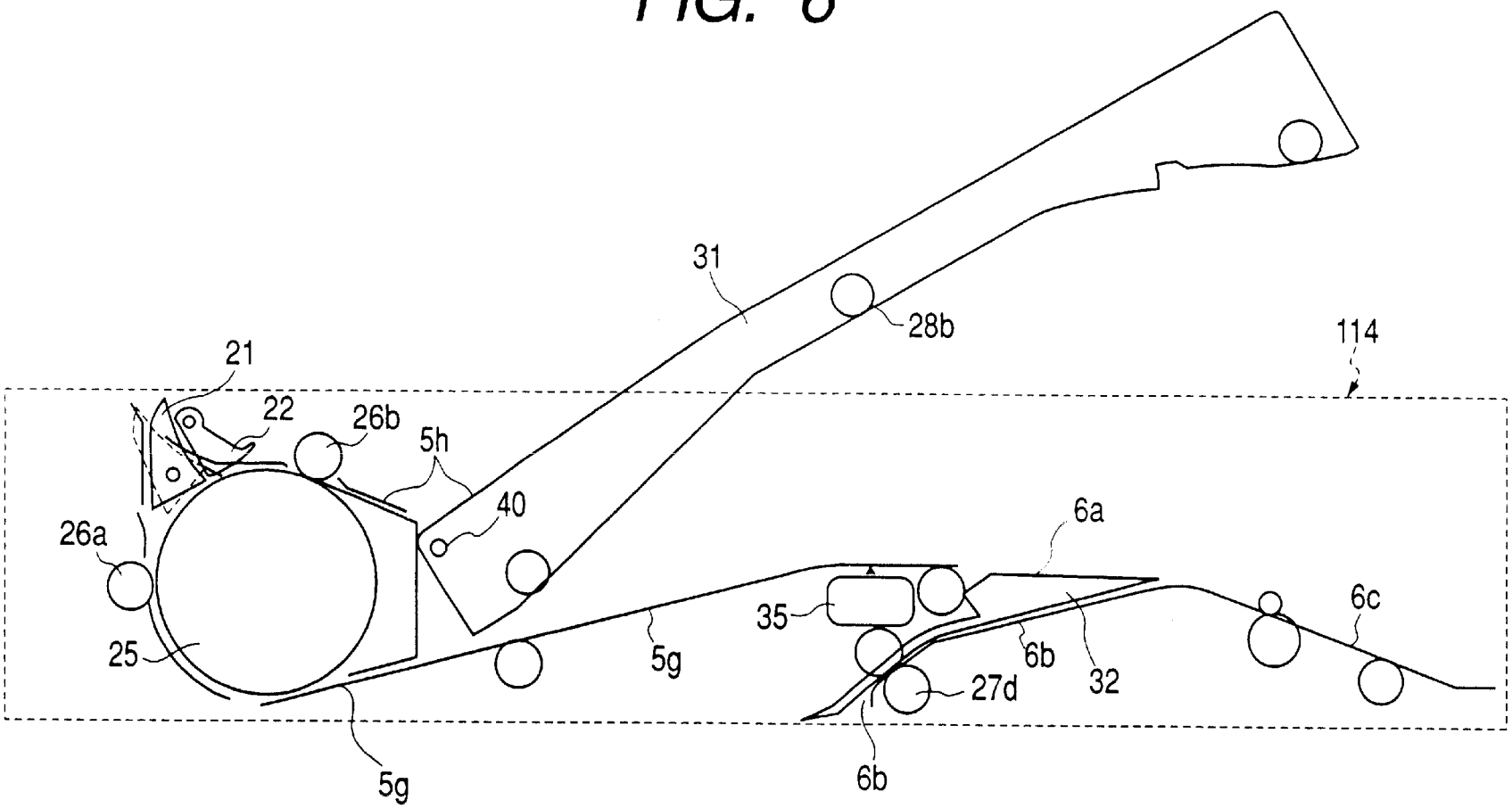
FIG. 6 is a view showing the state of jammed sheet clearance in the above-mentioned two-side reversing unit.

Moreover, as the openable and closable guide 31 is made of a transparent plastic material through which the user can see the inside, the user can easily confirm the sheet S present on the conveying paths 5*g*, 6*a*, 6*c* by visual observation from above the two-side reversing unit 114, and can execute jam clearance by opening the openable and closable guide 31 after the confirmation (FIG. 6). Also a guide member 32, having the conveying path 6*b* at the lower surface and the conveying path 6*a* at the upper surface and communicating with the feed tray 1*b*, is made of a transparent plastic material through which the user can see the inside, so that the user can easily confirm the sheet S fed from the feed tray 1*b* and remaining on the conveying path 6*b*, by visual observation from above the two-side reversing unit 114, and easily clear such remaining sheet S for example by rotating the paired conveying rollers 28*d* after the confirmation.

As explained in the foregoing, the effective use of such transparent resinous material through which the user can see allows to prevent the failed removal of the sheet S and to enable jam clearance within a short time, with alleviated burden on the user in such operation.

At the upstream side of the paired conveying rollers 28*b*, there is provided, as shown in FIG. 5, a sheet end detection mechanism 35, which detects the sheet position of the sheet S re-conveyed to the image forming portion for the purpose of two-sided image formation, in a direction transversal to the conveying direction of the sheet S, and supplies the CPU 111 of the copying apparatus 111 with information on the detected position, thereby enabling to adjust the image forming position of the image formation on the second side.

Furthermore, the conveying route (the conveying paths 5*g*–6*a*–6*c*) is formed in a substantially upward convex form, so that. the sheet end detection mechanism 35 can be provided below the conveying path 6*a*.

As a result, the vertical dimension of the two-side reversing unit 114 solely depends on the dimension of the curved conveying route (the conveying paths 5*h*–15*j*–5*g*) having a minimum possible radius of curvature in order to achieve: sheet conveying in a stable state, and such configuration contributes significantly to the compactization of the two-side reversing unit 114 and also the main body 111 of the copying apparatus.

More specifically, in the present embodiment, the guide member 32 having the lower surface of the conveying path 6*a* and the upper surface of the conveying path 6*b* is made of a transparent material, so that the user can easily confirm the sheet S remaining in the conveying path 6*b*, by seeing through the guide member 32 from above by opening the openable and closable guide 31. After such visual confirmation, the jammed sheet can be easily cleared for example manually rotating the paired conveying rollers 28*d*.

By forming the guide member 32 with the transparent material, it is possible to see through the guide member 32 the interior of the conveying path 6*b* when the surface reversing path 5A is opened by the openable and closable guide 31. It is thus made possible to prevent the failed removal of the jammed sheet S and to alleviate the burden of the user in the jam clearance.

As explained in the foregoing, in the conveying unit mounted to be pulled out from between the image forming portion and the sheet containing portion, a first guide member constituting the lower surface of a first conveying path which is left open in the upper side thereof and the upper surface of a second conveying path is made of a transparent material and a second guide member constituting the lower surface of the second conveying path and the upper surface of a third conveying path is made of a transparent material, whereby it is possible to see through the first guide member the interior of the third conveying path when the first guide member is opend. Such configuration enables secure jam clearance while attaining compactization of the apparatus.

In the following there will be explained, with reference to FIG. 3, the heat curling of the sheet after passing the fixing device 4.

The toner image on the sheet S is fixed by heat and pressure applied by a heat roller 4*a* and a pressure roller 4*b* in the fixing device 4.

It is recently confirmed that, as a factor affecting the heat curling of the sheet, the sheet posture in the sheet conveying after heating has a significant influence. More specifically, by passing the sheeet through a curved conveying route after the sheet heating, the heat curling is reformed or enhanced in the direction of such curve.

For this reason, there is known a configuration of blowing cooling air to the sheet S for example from below the conveying path 5*a*, in order to dissipate the heat applied to the sheet as quickly as possible. In short, it is important not to bend the sheet while the heat is retained therein.

As explained in the foregoing, in contrast to the conveying route (the conveying paths 5*a*–5*b*–5*d*–5*h*) in the two-side reversing operation, the conveying route (the conveying paths 5*a*–5*b*–5*c*) for the sheet S in the surface reversed discharge is maintained linear after the sheet past through the fixing device 4 is bent by about 90° in the conveying paths 5*a* and S*b*, so that the influence on the heat curling of the sheet S after heating can be minimized.

Particularly in the small-sized sheet S which is often stacked in a large amount (about 1000–3000 sheets) after discharge, even a small curling of each sheet induces a large influence, so that the substantially straight conveying route (the conveying paths 5*b*–5*c*) capable of substantially linearly retaining the small-sized sheet S is greatly effective. Stated differently, the heat curling can be securely reduced in the small-sized sheet S by the substantially linear conveying route (the conveying paths 5*b*–5*c*).

Among various,kinds of the sheets S, the heat curling may be different in the magnitude or even in the direction thereof, even under same heating and pressurizing conditions. In order to handle such sheets, it is also possible, in the surface reversed discharge, to convey the sheet in the curved conveying route (the conveying paths 5*b*–5*d*) while the temperature of the sheet S is still high, thereby correcting the heat curling by a curve formed by the conveying paths 5*b* and 5*d*. Such heat curl correction of the sheet S by the curved conveying route (the conveying paths 5*b*–5*d*) can be easily achieved by changing the switching control of the second duplex flapper 21.

In such case, it is possible to arbitrarily change the conveying route by the user or the service person through unrepresented input means, or to assign each of the feeding trays 1*a*–1*d* to the sheets S to be used, and to cause the control device to automatically select the conveying route (substantially linear or curved) in the surface reversed discharge according to the selected feeding tray.

It is furthermore possible to employ sheet thickness detection means and to cause the control device to automatically select the conveying route based on the sheet thickness information obtained by the sheet thickness detection means.

The present image forming apparatus, in which the inner diameter surface of a curved portion for executing the surface reversing operation for the sheet is constituted by the external periphery of a rotary member, is capable of achieving stable sheet conveying and a high productivity, while attaining compactization and cost reduction of the apparatus. In addition, control on the rotating direction of the rotary member and on the sheet conveying direction by the rotary member allows to achieve stable sheet conveying according to the length of the sheet and also to achieve a high productivity.

What is claimed is:

1. An image forming apparatus comprising:

image forming means for forming an image on a sheet;

a re-conveying path for re-conveying the sheet on one side of which the image has been formed to said image forming means for forming an image on the other side of the sheet; and a sheet containing portion for feeding the sheet to a conveying path interflowing into a middle of said re-conveying path, wherein, when the sheet on one side of which the image has been formed is once stopped and temporarily held in said re-conveying path, a leading end of the sheet on one side of which the image has been formed and which has been once stopped and temporarily held is positioned downstream of an interflowing position, and wherein a new sheet fed from said sheet containing portion is conveyed from the conveying path through said re-conveying path to pass the stopped and temporarily held sheet.

2. An image forming apparatus according to claim 1, wherein a conveying path extending through said image forming means, said re-conveying path and said sheet containing portion mutually and successively overlap in a direction of height.

3. An image forming apparatus according to claim 2, further comprising conveying rollers upstream and downstream of said interflowing position, respectively, wherein a stopping position is immediately in front of said conveying roller downstream of said interflowing position.

4. An image forming apparatus according to claim 3, wherein a downstream part of said re-conveying path interflows into a vertical conveying path for conveying a sheet from another sheet containing portion.

5. An image forming apparatus according to claim 4, wherein said re-conveying path protrudes toward said image forming means, in the interflowing position of said re-conveying path.

6. An image forming apparatus according to claim 5, further comprising a sensor for detecting an end of the sheet, in said re-conveying path.

7. An image forming apparatus comprising:

image forming means for forming an image on a sheet;

a re-conveying path for re-conveying the sheet on one side of which the image has been formed to said image forming means for forming an image on the other side of the sheet;

a sheet containing portion for feeding the sheet to a conveying path interflowing into a middle of said re-conveying path;

a surface reverse conveying path provided upstream of said re-conveying path for reversing a front and a back surfaces of the sheet on one side of which the image has been formed;

an arc-shaped conveying path connecting said surface reverse conveying path and said re-conveying path; and a conveying roller of which an external periphery serves as an inner diameter side surface of said arc-shaped conveying path, wherein, when the sheet on one side of which the image has been formed is once stopped and temporarily held in said re-conveying path, a leading end of the sheet on one side of which the image has been formed and which has been once stopped and temporarily held is positioned downstream of an interflowing position.

8. An image forming apparatus comprising:

image forming means for forming an image on a sheet;

a re-conveying path for re-conveying the sheet on one side of which the image has been formed to said image forming means for forming an image on the other side of the sheet;

a sheet containing portion for feeding the sheet to a conveying path interflowing into a middle of said re-conveying path; and a surface reverse conveying path for reversing a front and a back surfaces of the sheet above said re-conveying path, said surface reverse conveying path and said re-conveying path overlapping each other, wherein said re-conveying path and said surface reverse conveying path communicate with each other through a large-diameter roller, wherein, when the sheet on one side of which the image has been formed is once stopped and temporarily held in said re-conveying path, a leading end of the sheet on one side of which the image has been formed and which has been once stopped and temporarily held is positioned downstream of an interflowing position.

9. An image forming apparatus according to claim 8, wherein said re-conveying path, said surface reverse conveying path and said large-diameter roller can be pushed in and pulled out in unison as a unit.

* * * * *

UNITED STATES PATENT AND TRADEMARK OFFICE

CERTIFICATE OF CORRECTION

PATENT NO. : 6,477,352 B2
DATED : November 5, 2002
INVENTOR(S) : Masahiro Takahashi et al.

It is certified that error appears in the above-identified patent and that said Letters Patent is hereby corrected as shown below:

Title page,
Item [57], ABSTRACT,
Line 9, "waited" should read -- held --.

Column 1,
Line 22, "An" should read -- an --.
Line 25, "to" should read -- to be transferred onto the sheet by the transfer means is --.
Line 31, "afterimage" should read -- after image --.

Column 2,
Line 10, "waiting" should read -- held --.
Line 22, "a damage in" should read -- in damage to --.

Column 3,
Line 44, "is" should read -- are --.
Line 50, "waited" should read -- held --.
Line 64, "a" should read -- an --.

Column 6,
Line 9, "5g-5g)" should read -- 5j-5g) --.
Line 30, "once stops" should read -- stops once --.
Line 43, "a damage in" should read -- damage to --.
Line 63, "roller 35," should read -- roller 25, --.

Column 9,
Line 56, "sheed" should read -- sheet --.

Column 11,
Line 12, "5g-tg)" should read -- 5j-5g) --.
Line 35, "darwing" should read -- drawing --.

Column 12,
Line 27, "paird" should read -- paired --.

UNITED STATES PATENT AND TRADEMARK OFFICE

CERTIFICATE OF CORRECTION

PATENT NO. : 6,477,352 B2
DATED : November 5, 2002
INVENTOR(S) : Masahiro Takahashi et al.

It is certified that error appears in the above-identified patent and that said Letters Patent is hereby corrected as shown below:

Column 14,
Line 4, "5h-15j-5g)" should read -- 5h-5j-5g) --.
Line 5, "achieve:" should read -- achieve --.
Line 35, "opend." should read -- opened. --.
Line 46, "sheeet" should read -- sheet --.
Line 57, "past" should read -- passed --.
Line 59, "Sb," should read -- 5b, --.

Column 15,
Line 3, "various,kinds" should read -- various kinds --.

Signed and Sealed this

Nineteenth Day of August, 2003

JAMES E. ROGAN
*Director of the United States Patent and Trademark Office*